US011401133B2

(12) United States Patent
Boxum et al.

(10) Patent No.: US 11,401,133 B2
(45) Date of Patent: Aug. 2, 2022

(54) METHOD OF CONTROLLING A STAIRLIFT AND A STAIRLIFT

(71) Applicant: TK Home Solutions B.V., Krimpen aan den Ijssel (NL)

(72) Inventors: Cornelis Boxum, Delfgauw (NL); Paul Kasbergen, Capelle aan den Ijssel (NL); Albertus Blokzijl, Capelle aan den Ijssel (NL)

(73) Assignee: TK Home Solutions B.V., Krimpen aan den Ijssel (NL)

( * ) Notice: Subject to any disclaimer, the term of this patent is extended or adjusted under 35 U.S.C. 154(b) by 368 days.

(21) Appl. No.: 16/490,671

(22) PCT Filed: Mar. 8, 2018

(86) PCT No.: PCT/EP2018/055729
§ 371 (c)(1),
(2) Date: Sep. 3, 2019

(87) PCT Pub. No.: WO2018/162627
PCT Pub. Date: Sep. 13, 2018

(65) Prior Publication Data

US 2020/0017332 A1 Jan. 16, 2020

(30) Foreign Application Priority Data

Mar. 8, 2017 (DE) ..... 10 2017 203 774.1

(51) Int. Cl.
*B66B 1/30* (2006.01)
*B66B 9/08* (2006.01)

(52) U.S. Cl.
CPC ..... *B66B 1/30* (2013.01); *B66B 9/08* (2013.01); *B66B 9/0853* (2013.01)

(58) Field of Classification Search
CPC ..... B66B 1/30; B66B 9/08; B66B 9/0853; B66B 9/0838; B66B 9/0807
See application file for complete search history.

(56) References Cited

U.S. PATENT DOCUMENTS 2,888,099 A * 5/1959 Hoffmann ..... B66B 9/0838 187/202
4,913,264 A * 4/1990 Voves ..... B66B 9/08 187/201

(Continued)

FOREIGN PATENT DOCUMENTS

CN 102038375 A 5/2011
CN 204751795 U 11/2015

(Continued)

OTHER PUBLICATIONS

First Office Action issued in Counterpart Chinese Patent Application No. CN 201880016512.3, dated Jul. 17, 2020, listing new references cited above that have not been previously submitted to USPTO in a prior filed IDS.

(Continued)

*Primary Examiner* — Michael A Riegelman
(74) *Attorney, Agent, or Firm* — William J. Cassin

(57) ABSTRACT

A method of controlling a stairlift, the stairlift including a rail, a chair, and a drive assembly having a drive engine for driving the chair along the rail. The chair is attached to the drive assembly and the chair has an armrest, wherein the armrest is pivotably supported at the chair by a hinge. The hinge allows a rotational movement of the armrest, in particular along a vertical axis. The method includes detecting an angular position of the armrest and controlling at least one functionality of the stairlift, in particular a functionality of the drive assembly, as a function of the detected angular position.

13 Claims, 4 Drawing Sheets

(56) References Cited

U.S. PATENT DOCUMENTS 5,533,594 A * 7/1996 Tremblay ..... B66B 9/0838 187/201
D489,859 S * 5/2004 Yamada ..... D34/28
D679,884 S * 4/2013 Heijns ..... D34/35
9,776,830 B2 * 10/2017 Ooms ..... B66B 9/08
2006/0087097 A1 * 4/2006 Kramer ..... A61G 7/1059 280/304.1
2006/0185937 A1 * 8/2006 Caroen ..... B66B 9/0853 187/201
2006/0260876 A1 * 11/2006 Woodhams ..... B66B 9/08 187/201
2007/0051562 A1 * 3/2007 Titchener ..... B66B 9/0853 187/200
2007/0235265 A1 * 10/2007 Vroegindeweij ..... B66B 9/0838 187/201
2008/0203775 A1 * 8/2008 Caroen ..... B66B 9/08 297/30
2008/0271953 A1 * 11/2008 Vroegindeweij ..... B66B 9/0838 187/245
2010/0263966 A1 * 10/2010 Linton ..... B66B 9/0853 187/201
2010/0314201 A1 * 12/2010 Stannah ..... B66B 9/0853 187/201
2013/0068566 A1 * 3/2013 Heijns ..... B66B 9/08 187/201
2014/0326540 A1 * 11/2014 Ooms ..... B66B 1/468 187/201
2014/0332320 A1 * 11/2014 Woodhams ..... B66B 9/0853 187/201
2016/0075535 A1 * 3/2016 Ooms ..... A61G 5/128 297/344.14
2017/0158464 A1 * 6/2017 De Kroon ..... B66B 9/0838
2017/0240383 A1 * 8/2017 Wilson ..... B66B 9/0853
2018/0044133 A1 * 2/2018 Cook ..... B66B 1/30
2018/0072537 A1 * 3/2018 Pugh ..... B66B 9/0807
2019/0382243 A1 * 12/2019 van Eijgen ..... B66B 5/02
2020/0017332 A1 * 1/2020 Boxum ..... B66B 1/30
2021/0161295 A1 * 6/2021 Wilson ..... E04F 11/02

FOREIGN PATENT DOCUMENTS

DE 20 2012 100 417 U 3/2012
GB 2 469 093 A 10/2010
JP H08 12240 A 1/1996
WO 2013/129923 A 9/2013
WO 2014/158020 A 10/2014
WO 2016/059380 A1 4/2016

OTHER PUBLICATIONS

International Search Report issued in PCT/EP2018/055729, dated Jun. 15, 2018.

Office Action in Canadian counterpart patent application No. 3,951,637, dated Nov. 3, 2020, listing the above references that have not previously been in an IDS in the present US application.

Office Action, dated Jan. 18, 2022, in Chinese counterpart patent application No. 201880016512.3, citing the above identified references that have not previously been listed in an IDS in the present US application.

* cited by examiner

| max. swivel angle ($\alpha_{max}$) | armrest position (left) | | | |
|---|---|---|---|---|
| | A | B | C | D |
| rail section I | 90 | 90 | 60 | 45 |
| II | 90 | 90 | 45 | 20 |
| III | 90 | 90 | 45 | 20 |
| IV | 90 | 90 | 90 | 45 |

| max. swivel angle ($\alpha_{max}$) | armrest position (right) | | | |
|---|---|---|---|---|
| | A | B | C | D |
| rail section I | -90 | -90 | 60 | -45 |
| II | -90 | -90 | -45 | -20 |
| III | -90 | -90 | -45 | -20 |
| IV | -90 | -90 | 60 | -45 |

Fig. 7

METHOD OF CONTROLLING A STAIRLIFT AND A STAIRLIFT

CROSS REFERENCE TO RELATED APPLICATIONS

This application is a U.S. National Stage Entry of International Patent Application Serial Number PCT/EP2018/055729, filed Mar. 8, 2018, which claims priority to German Patent Application No. DE 10 2017 203 774.1, filed Mar. 8, 2017, the entire contents of both of which are incorporated herein by reference.

FIELD

The present disclosure generally relates to a method of controlling a stairlift and a stairlift.

BACKGROUND

WO 2013/129923 A1 discloses a stairlift. The stairlift comprises a chair mounted on a drive assembly. The drive assembly travels along at least one guide rail. A leveling mechanism is provided to hold the chair always in a horizontal orientation, even if the inclination angle of the guide rail is changing.

Typically, stairlifts have a chair which can be folded in order to safe space on the staircase when the stairlift is not in use. In most cases, the armrest can be folded by rotating the armrest partly around a horizontal axis. When unfolding the armrest, the armrest is rotated downwards until it reaches a mechanical stop and the armrest stays in this position due to gravitational forces. To support different sizes of person there are curved armrests for small users and straight armrests for large users. Both types rotate around a horizontal axis.

Thus a need exists for an improved stairlift, providing improved safety and comfort.

BRIEF DESCRIPTION OF THE FIGURES

FIG. 7 is a table showing allowed conditions referring to the angular position of the armrest and swiveling position of the chair.

DETAILED DESCRIPTION

Figure 1:
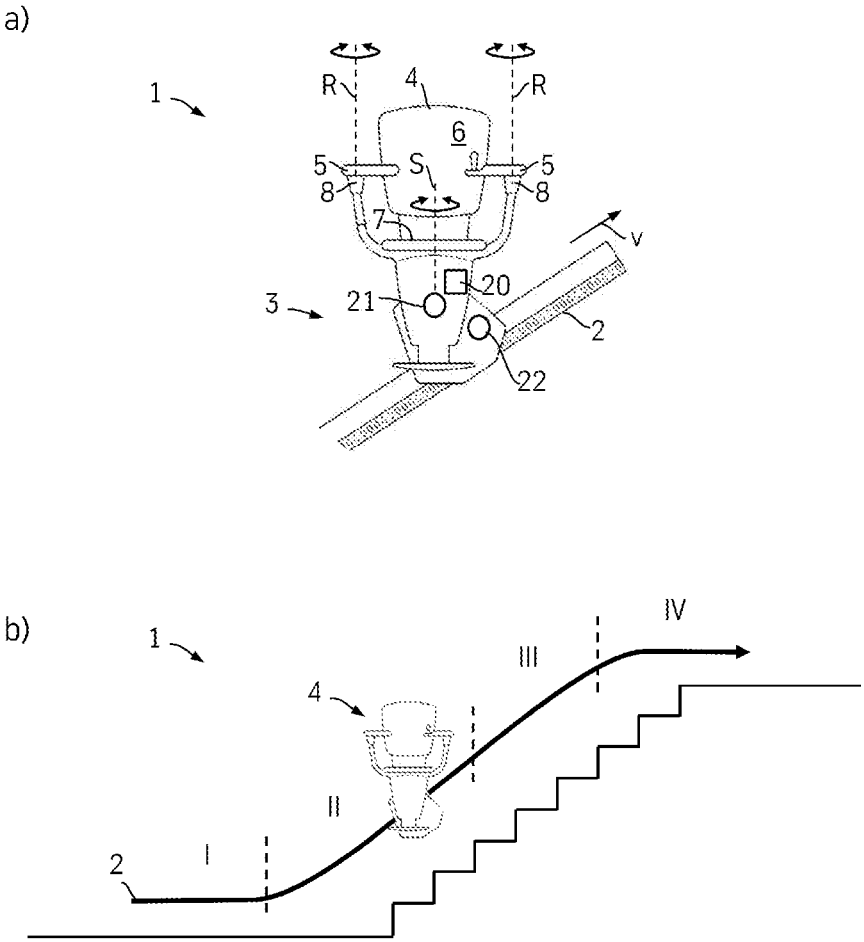
FIG. 1 is an inside view of an inventive stairlift.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention refers to a method of controlling a stairlift and a stairlift.

The inventive stairlift comprises a rail, a chair, a drive assembly having a drive engine for driving the chair along the rail, the chair is attached to the drive assembly, the chair having an armrest, wherein the armrest is pivotably supported at the chair by a hinge, which allows a rotational movement of the armrest, in particular along a vertical axis. The inventive method comprises the steps of detecting an angular position of the armrest; the step of controlling at least one functionality of the stairlift, in particular a functionality of the drive assembly, as a function on the detected angular position.

In the inventive stairlift the armrest serves in particular for securing the passenger against dropping out of the chair. This is only possible in certain positions of the armrest. By the inventive detection step it can be checked, whether the armrest is in a position of securing the person. If the armrest is not in appropriate position of securing the person, e.g. the engine may not be driven the swiveling mechanism may be blocked.

In an embodiment the functionality may be a functionality of the drive engine, in particular driving the drive engine or stopping the drive engine or altering a drive speed of the drive assembly along the rail.

In an embodiment the drive assembly comprises a swivel engine for swiveling the chair along a vertical axis. In this embodiment the at least one functionality of the stairlift is a functionality of the swivel engine of the drive assembly, in particular driving the swivel engine or stopping the swivel engine or altering a swivel angle of the chair. Here the knowledge of the armrest position can be used to decide whether the swivel engine is e.g. allowed to swivel the chair or not. Since the armrest may radially protrude in several positions, it may improve the safety, if the chair is being hindered from swiveling.

In an embodiment the step of controlling a functionality of the drive assembly is performed additionally as a function of the position of the chair along the rail. The spatial conditions may vary at different positions along the rail. Thus some restrictions in the functionality can be limited to certain positions.

The inventive stairlift has an angular sensor for detecting the angular position of the armrest.

In particular, the armrest can be pivoted about a vertical axis. This allows that in a radially outward armrest position the armrest can be used for supporting the person getting on or off the chair. However this position of the armrest may be comfortable during entry, the position must be changed due to the above mentioned safety reasons.

In an embodiment the control unit is adapted to control the drive assembly as a function of the angular position detected by the angular sensor. The advantageous and the improvements described with reference to the method are generally applicable to the apparatus claims.

In an embodiment the chair comprises a, in particular a spring loaded, latch mechanism to lock the armrest in a, in particular in-discrete, angular position. A latch sensor is provided for detecting, whether the latch mechanism is in a locked state or an unlocked state. The step of controlling a functionality of the drive assembly can be performed additionally as a function of the result of the checking step. By this functionalities which require safety measurements can be supported by an improved safety standard.

FIG. 1 shows an exemplary embodiment of an inventive stairlift 1. The stairlift 1 comprises a rail 2 and a drive assembly 3 with a drive engine 22, which travels along the rail 2. The drive engine 22 drives the drive assembly 3. A chair 4 having a seating 7 and a backrest 6 is mounted to the drive assembly 3. The chair 4 has two armrests 5 mounted by a hinge 8, which allows a pivotal movement of the armrest 5 along a vertical axis R. The stairlift 1 comprises further a swivel engine 21, which is adapted to swivel the chair 4 relative to the drive assembly 3 along a vertical axis S. By swiveling the chair 4, a collision of the chair 4 or the person sitting on the chair with obstacles in the path can be avoided. A control unit 20 is provided for controlling the functions of the stairlift 1.

Figure 2:
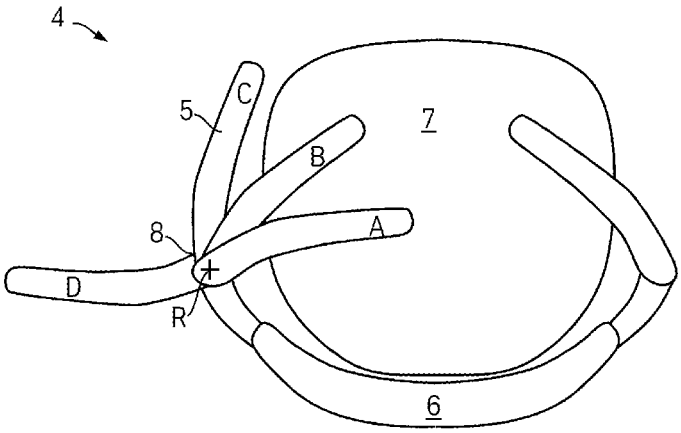
FIG. 2 is a top view of the chair of the stairlift of FIG. 1.

FIG. 2 shows the left armrest 5 in different angular positions A-D. In position A no person can be accommodated on the chair 4. The position A is for storing the chair 4, when the stairlift 1 is not in use. In this armrest position also the chair 4 can be folded to reduce the storage space.

In position B a small or medium sized person can be accommodated on the chair, in position C a tall sized person can be accommodated. In the position B and C the armrest serves also for securing the person against dropping out of the chair.

In position D, the armrest 5 is opened for allowing a person to enter or leave the chair 4, e.g. from or to a wheelchair. In position D it is not allowed to move the chair. In an embodiment the drive engine 22 may be blocked, when the armrest position A or D is detected. Then it is prevented to move the drive assembly along the rail.

Figure 3:
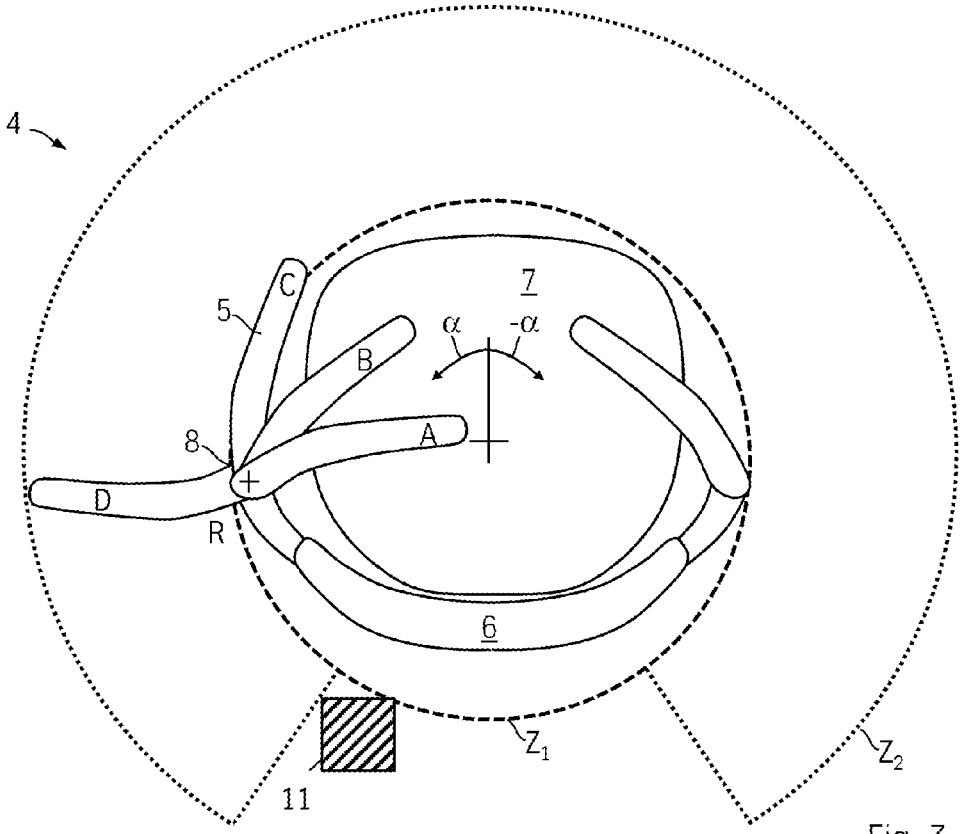
FIG. 3 is a top view of the chair of the stairlift of FIG. 1 in a first swiveling position and an obstacle.

FIG. 3 shows the upper part of the chair 4 in a first angular position $\alpha=0°$. There are shown two clearance zones $Z_1$, $Z_2$. The first zone $Z_1$ is a small clearance zone, which is kept free from any obstacles 11. It allows that the chair 4 can be swiveled along a swivel angle $\alpha$ of even +/−180° (in both directions), without colliding with an exemplary obstacle 11, when the armrest is in position A or B. However in practice the swivel motion will usually be stopped at $\alpha=+/-90°$, because a footrest (non-shown) may collide latest at $\alpha=+/-90°$ with the rail 2.

Figure 4:
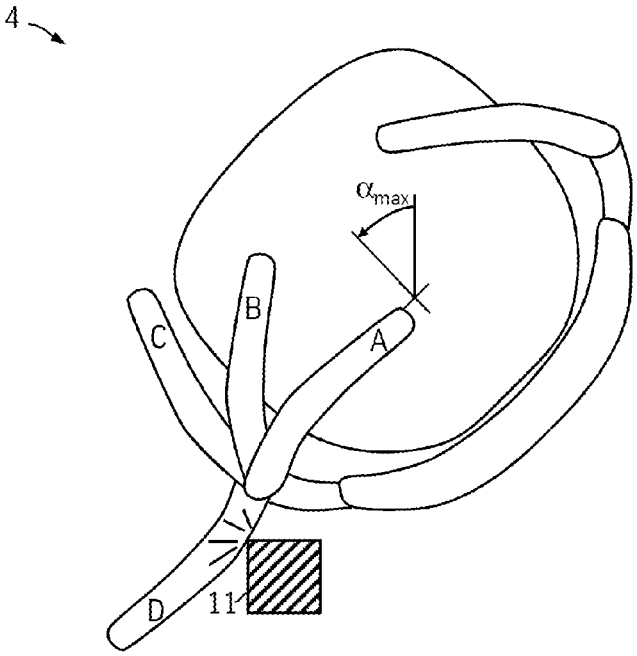
FIG. 4 is atop view of the chair of the stairlift of FIG. 1 in a second swiveling position and the obstacle.

If the armrest 5 is in position C or position D, the armrest 5 may collide at a certain angular position with the obstacle 11 (FIG. 4). Therefore a second clearance zone Z2 is established, which has a larger radial extent, but a reduced angular extent compared to the first clearance zone Z1. Accordingly a maximum angular position $\alpha_{max}$ of e.g. 60° is defined and linked to armrest position C. These maximum angular positions may be defined for each individual stairlift installation and each armrest position, based on the limiting features at the respective individual staircase. Further the maximum angular positions may be defined separately for individual positions of the path of travel. Because at a position of the rail, where are no obstacles, no additional limitation of the swivel angle is necessary. In an embodiment a obstacle clearance zone may be provided around an obstacle. The obstacle clearance zone must not intrude into the first and/or second clearance zones.

Figure 5:
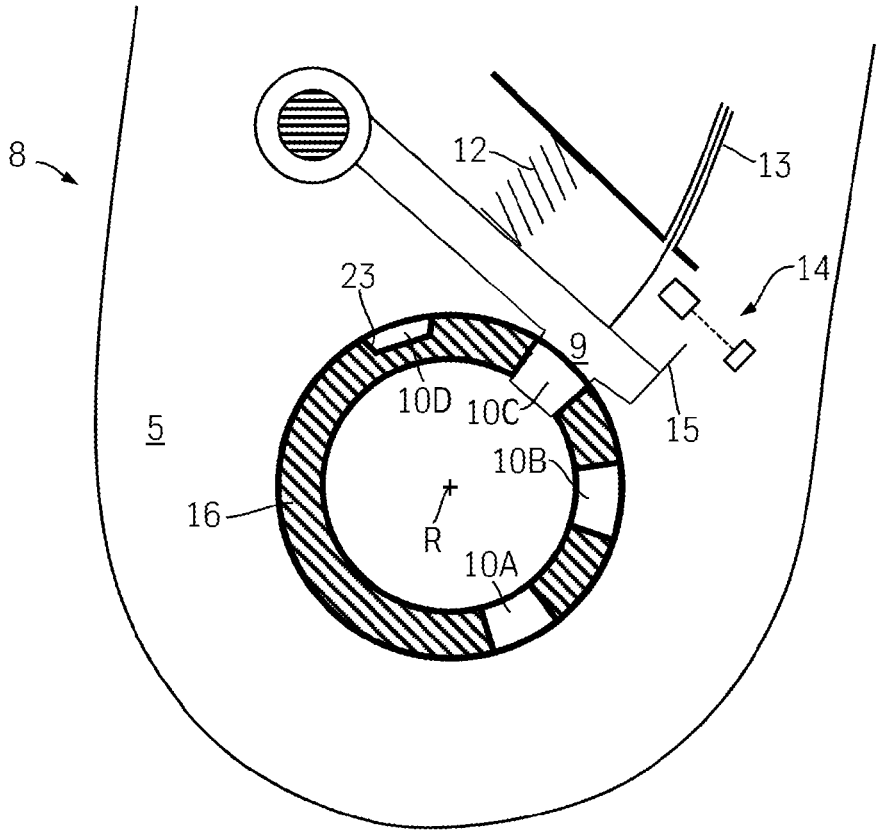
FIG. 5 is a top view of a hinge area of the armrest of the stairlift of FIG. 1.

FIG. 5 shows the armrest locking mechanism. In the hinge 8 a movable latch 9 is provided which is rotatably supported against a ring shaped latch plate 16. In this example the latch 9 is fixed to the armrest; the latch plate 16 is fixed to the chair 5. The latch plate 16 comprises a number of latch seats 10A-10D, in which the movable latch 9 can protrude. When the movable latch 9 protrudes into one of the latch seats 10, the latch 9 is in a locked state (shown in FIG. 5), otherwise in an unlocked state. A spring 12 biases the movable latch 9 into the locked state. With the help of a bowden cable 13 and a not shown actuating lever a user can bias the movable latch 9 against the spring force of the spring 22 into the unlocked state.

An optocoupler 14 is provided to detect if the movable latch 9 is in a locked or unlocked state. In the unlocked state a vane 15, which is fixed to the latch 9, cuts through a light beam of the optocoupler. The optocoupler cannot detect the current angular position A-D of the armrest 5.

When the movable latch 9 is in an angular position so that it can protrude into latch seat 10A, the armrest 5 is in position A. When the movable latch 9 is in an angular position so that it can protrude into latch seat 10B, the armrest 5 is in position B. When the movable latch 9 is in an angular position so that it can protrude into latch seat 10C, the armrest 5 is in position C. When the movable latch 9 is in an angular position so that it can protrude into latch seat 10D, the armrest 5 is in position D.

The latch seat 10D has a smaller depth than the other latch seat 10A-10C. Further the flanks 23 of this latch seat 10D are more angled with respect to the radial direction, than the flanks of the other latch seats 10A-10C. This enables that, for transferring the latch into the unlocked state out of latch seat 10D, the bowden cable does not need to be pulled. Solely turning the armrest with a certain amount of force may overcome the spring force. The other latch seats are shaped, so that the unlocked state can solely be reached by pulling the bowden cable.

Figure 6:
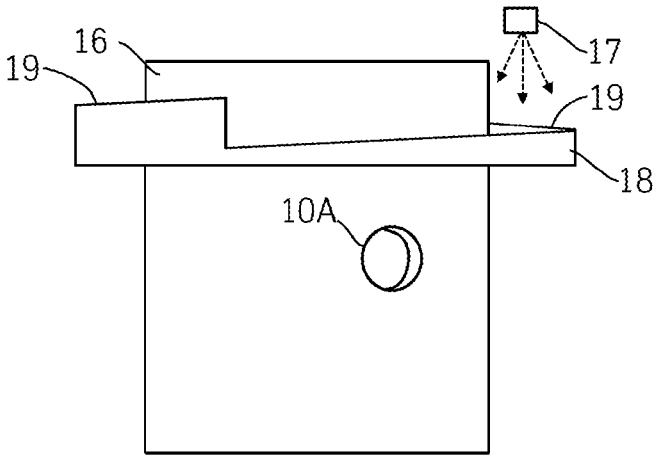
FIG. 6 is an inside view of a part of the hinge area of FIG. 5.

Based on FIG. 6 it is described, how the angular position of the armrest is detected. A light feeler 17 provides a cone shaped light beam or a scattering light. A reflective plate surface 19, mounted on a ring 18 can reflect the light, arriving on the surface 19. Turning the armrest along axis R the ring 18 pivots relative to the feeler 17. The reflective surface 19 has an inclination in circumferential direction. Thus each angular position is characterized by a specific distance between the feeler 17 and the surface 19. The smaller the distance between the feeler 17 and the surface 19, the smaller is the amount of reflective light, arriving at the feeler 17. The larger the distance between the feeler 17 and the surface 19, the smaller is the amount of reflective light, arriving at the feeler 17. The inclination of the surface 19 is shown as a continuous inclination; however a stepwise inclination is also possible, resulting in a smaller angular resolution of the sensor, which is acceptable in this case, because merely an angular resolution of the four positions A-D is requested.

With the help of the optocoupler 14 it is detected, whether or not the latch 9 is locked in any of the predefined angular positions; with the help of the feeler 17 the angular position is determined.

FIG. 7 shows an exemplary table of allowed conditions referring to the maximum allowed swivel angle. This maximum allowed angle is a function of the armrest position and of the rail position. E.g. when the drive assembly is at lower stop position (e.g. section I in FIG. 1*b*) the chair can be swiveled by +/−90° degree. E.g. when the drive assembly is in a middle rail section II and the left armrest is in position D, the maximum swivel angle is 20°.

In an alternative embodiment the regulations may be more strict. Here if the armrest is in position D the swivel mechanism and the drive mechanism are always blocked. So before swiveling and driving is allowed the armrest must be brought preferably in one of the positions A, B or at least in in position C.

A violation of these conditions leads to a stop of the drive engine 22 and/or a stop of the swivel engine 21. If afterwards the user turns the armrest back and thus establishes an allowed condition, the engines may get a signal to proceed.

LIST OF REFERENCE SIGNS

1 stairlift
2 rail
3 drive assembly
4 chair
5 armrest
6 backrest
7 seating
8 hinge
9 movable latch
10 latch seat
11 obstacle
12 spring
13 bowden cable
14 latch sensor/optocoupler
15 vane at latch
16 ring shaped latch plate
17 angular sensor/light feeler
18 ring
19 reflective surface
20 control unit
21 swivel engine
22 drive engine
S vertical swivel axis
R vertical armrest axis
Z swivel clearance area
v drive speed of drive assembly

What is claimed is:

1. A method of controlling a stairlift having a rail, a chair, a drive assembly having a drive engine for driving the chair along the rail, the chair attached to the drive assembly, the chair having an armrest, wherein the armrest is pivotably supported at the chair by a hinge having a vertical axis of rotation that permits the armrest to rotate in a horizontal plane about the vertical axis, the method comprising:

rotating the armrest in the horizontal plane about the vertical axis of the hinge;

detecting a current horizontal rotational angular position of the armrest about the vertical axis; and controlling a functionality of the stairlift as a function of the detected horizontal angular position.

2. The method of claim 1, wherein the functionality is a functionality of the drive assembly.

3. The method of claim 1, wherein the functionality is a functionality of the drive engine.

4. The method of claim 3, wherein the functionality of the drive engine includes driving the drive engine, stopping the drive engine, or altering a drive speed of the drive assembly along the rail.

5. The method of claim 1, wherein the drive assembly comprises a swivel engine configured to swivel the chair along a vertical axis, and the functionality of the stairlift is a functionality of the swivel engine of the drive assembly.

6. The method of claim 5, wherein the functionality of the swivel engine is driving the swivel engine, or stopping the swivel engine, or altering a swivel angle of the chair.

7. The method of claim 1, further comprising:

controlling a functionality of the drive assembly as a function of the position of the chair along the rail.

8. The method of claim 1, wherein said detecting of the angular position of the armrest additionally checks that the armrest is secured by a locking mechanism and said controlling a functionality of the drive assembly is performed additionally as a function of the result of said check.

9. A stairlift, comprising:

a rail;

a drive assembly configured to drive along the rail; and a chair attached to the drive assembly, the chair including, an armrest connected to the chair by a hinge having a vertical axis of rotation, which hinge is configured to allow the armrest to be rotated horizontally about the vertical axis to various horizontal rotational angular positions within a horizontal plane, an angular position sensor configured to detect the horizontal rotational angular position of the armrest, and a control unit configured to control the drive assembly as a function of the horizontal rotational angular position detected by the angular position sensor.

10. The stairlift of claim 9, wherein the rotational movement of the armrest is performed along a vertical axis.

11. The stairlift of claim 9, wherein the chair comprises a latch mechanism to lock the armrest and a latch sensor is configured to detect whether the latch mechanism is in a locked state or in an unlocked state.

12. The stairlift of claim 11, wherein the latch mechanism is spring loaded.

13. The stairlift of claim 11, wherein the latch mechanism is configured to lock the armrest in discrete, angular positions.

* * * * *